United States Patent [19]

Sneijers et al.

[11] Patent Number: 4,560,903

[45] Date of Patent: Dec. 24, 1985

[54] HIGH PRESSURE DISCHARGE LAMP

[75] Inventors: Andreas P. E. Sneijers; Jacobus M. M. Claassens; Roger J. Q. Van den Plas, all of Eindhoven, Netherlands

[73] Assignee: U.S. Philips Corporation, New York, N.Y.

[21] Appl. No.: 461,783

[22] Filed: Jan. 28, 1983

[30] Foreign Application Priority Data

Feb. 26, 1982 [NL] Netherlands ..... 8200783

[51] Int. Cl.[4] ..... H01J 61/30; H01J 61/36

[52] U.S. Cl. ..... 313/625; 313/634

[58] Field of Search ..... 313/634, 573, 623, 624, 313/625, 631

[56] References Cited

U.S. PATENT DOCUMENTS 3,243,635 3/1966 Louden et al. ..... 313/623 X
3,485,343 12/1969 Jorgensen ..... 313/559 X
3,534,213 10/1970 Simon et al. ..... 313/624 X
3,726,582 4/1973 Tol et al. ..... 313/623 X
4,315,187 2/1982 Chow ..... 313/631 X

*Primary Examiner*—Palmer C. DeMeo
*Assistant Examiner*—Sandrah O'Shea
*Attorney, Agent, or Firm*—Robert S. Smith

[57] ABSTRACT

The invention relates to a high-pressure discharge lamp comprising a discharge vessel enclosing a discharge space and provided with two main electrodes. Each of the main electrodes is connected to a lead-through element which is enclosed with an intermediate space by a closing part and is connected thereto in a gas-tight manner by means of a sealing joint. According to the invention, the lead-through element is provided with a protuberance reaching as far as the closing part and being present around the whole periphery of the lead-through element. In this manner, a screening of the sealing joint from the discharge space is obtained.

5 Claims, 6 Drawing Figures

HIGH PRESSURE DISCHARGE LAMP

The invention relates to a high-pressure discharge lamp comprising a discharge vessel which encloses a discharge space and is provided with a ceramic wall and with two main electrodes. Between these electrodes in the operating condition of the lamp the discharge takes place and at least one of which is connected to a lead-through element which is passed through a closing part of the discharge vessel and is enclosed with an intermediate space by the closing part and is connected thereto in a gas-tight manner by a sealing joint which extends in the intermediate space. The term ceramic wall is to be understood herein to mean a wall consisting of a crystalline oxide, such as, for example, monocrystalline sapphire or poly-crystalline densely sintered alumina. The closing part may be constituted by the wall of the discharge vessel itself. It is alternatively possible for the discharge vessel to be provided with a separate end plug which is connected, for example, by sintering to the wall of the discharge vessel. The filling of the discharge vessel may comprise besides one or more metals also one or more rare gases and one or more halides. The filling may be present partially in excess quantity.

A lamp of the kind mentioned in the preamble is known from the Dutch Patent Application No. 7704135 a counterpart of U.S. Pat. No. 4,196,586. The known lamp, which is now frequently used for inter alia public illumination purposes, is an efficient light source. In the known lamp, the intermediate space is entirely filled with the sealing joint and the sealing joint material extends even along the lead-through element in the discharge space, as a result of which a comparatively large surface area of the sealing joint is in contact with filling constituents of the discharge vessel. It has been found that the sealing joint is frequently attacked in the operating condition of the lamp, as a result of which filling constituents are extracted from the discharge. This in turn leads to variation of the lamp properties, such as the arc voltage of the discharge, the luminous efficiency, and the color point of the emitted radiation. In the worst case, this may even lead to the extinction of the lamp.

The invention has for its object to provide means for limiting the attack of the sealing joint by constituents of the filling of the discharge vessel.

A lamp of the kind mentioned in the preamble is therefore characterized in that the extension of the sealing joint in the intermediate space on the side facing the discharge space is limited by a protuberance of the lead-through elements, the protuberance extending around the whole periphery of the lead-through element and reaching as far as the closing part.

In the lamp according to the invention, a surprisingly efficient screening between the sealing joint and the filling of the discharge vessel is obtained in a simple manner. The means moreover have the advantage that the length of the extension of the sealing joint can be controlled by means of the positioning of the protuberance of the lead-through member with respect to the closing part, as a result of which a satisfactory mechanical strength of the joint can be achieved in a reproducible manner.

It is possible for the lead-through element to be provided with a ring welded to the element. In a first embodiment of a lamp according to the invention, the lead-through element is a metal pin, which is disturbed by scraping at the area of the protuberance. This embodiment has the advantage that no separate element for the formation of the protuberance need to be secured to the lead-through element. In lead-through constructions of small dimensions, this embodiment can be advantageously used, in particular in lamps which in the operating condition dissipate a power of less than 50 W.

In a second embodiment of a lamp according to the invention, the lead-through element advantageously comprises a thin-walled metal tube which is upset at the area of the protuberance. Thus, it is possible to use a lead-through element frequently utilized in practice while simultaneously applying the invention.

In a next embodiment of a lamp according to the invention, the tube accommodate a cylinder which on the side facing the discharge is provided with a main electrode and on the side remote from the discharge is connected to the tube in a gas-tight manner. Thus, in an advantageous manner a construction of the lead-through element is obtained, in which on the one hand the sealing joint is screened from the discharge space and on the other hand the duct formed through the wall can be used to fill and exhaust the discharge vessel during the manufacture of the lamp. This construction moreover has the additional advantage that it is possible that, when the side of the tube and the cylinder remote from the discharge space is lengthened, the gas-tight joint between these two is formed at a comparatively large distance from the discharge space. Due to this comparatively large distance, the temperature of the discharge space and the filling present therein will remain comparatively low during the formation of the gas-tight joint, as a result of which undesired vaporization and disappearance of filling constituents are counteracted.

In another embodiment, the discharge vessel is provided with a separate exhaust duct closed in a gas-tight manner by means of a sealing joint. This embodiment has the advantage that the electrode and the associated lead-through construction can be arranged prior to exhausting the discharge vessel. The exhaust duct may also serve to introduce the filling into the discharge vessel. The surface of the sealing-joint closing the exhaust duct in a gas-tight manner will be, it is true, in direct contact with the filling of the discharge vessel. However, this surface area will be only comparatively small because the duct only serves to exhaust and, as the case may be, to fill the discharge vessel. Moreover, it has been found in practice that the sealing-joint attains in a space fully enclosed by crystalline oxide a considerably smaller extension as compared with a space partially enclosed by metal. This results in that the surface area of the sealing-joint, which is in contact with the filling of the discharge vessel, is substantially limited to the cross-section of the exhaust duct.

A lamp according to the invention will now be described with reference to a drawing, in which FIG. 1 shows the lamp;

Figure 1:
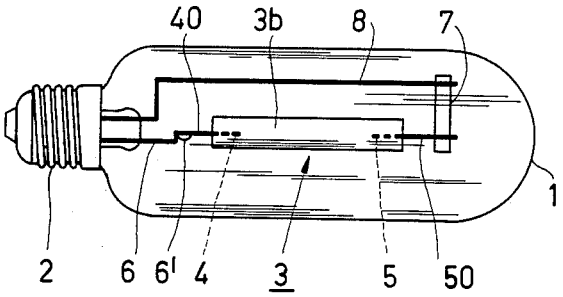

FIG. 1 shows a lamp having an outer bulb 1 and a lamp cap 2. Within the outer bulb 1 is situated a discharge vessel 3 which encloses a discharge space 3*b* and is provided with two main electrodes 4 and 5. The main electrode 4 is connected to a lead-through element 40 which is electrically connected through a flexible conductor 6' to a rigid current conductor 6. The main electrode 5 is connected to a lead-through element 50 which is electrically connected through an auxiliary conductor 7 to a rigid current conductor 8.

Figure 2:
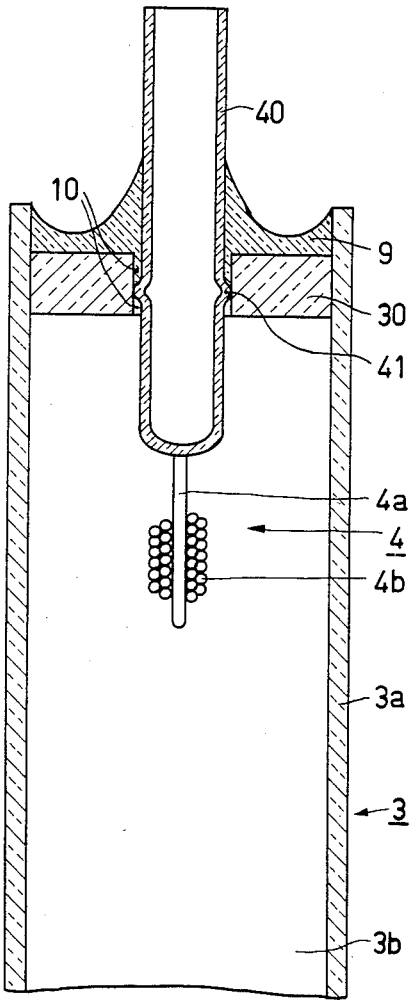
FIG. 2 shows in detail, partly in cross-sectional view, the discharge vessel of the lamp according to FIG. 1.

The part of the discharge vessel 3 with a ceramic wall 3*a* shown in cross-section in FIG. 2 comprises the main electrode 4 consisting of electrode turns 4*b* on an electrode rod 4*a* which is connected to the lead-through element 40. The lead-through element 40 is passed through the closing part 30 and is enclosed by the closing part 30 with an intermediate space 10. The closing part 30 consists of a separate ceramic end plug which is secured by sintering to the wall 3*a* of the discharge vessel. The lead-through element is provided around its hole periphery with a protuberance 41 which reaches as far as the closing part 30. The lead-through element is connected in a gas-tight manner to the closing part 30 by means of a sealing-joint 9. The sealing-joint 9 extends in the intermediate space 10 as far as the protuberance 41. The lead-through element 40 is constructed as a thin-walled tube of niobium or molybdenum, which is upset at the area of the protuberance 41. In the modification according to FIG. 3 of the part of the discharge vessel 3 shown in FIG. 2, the end plug 30 acting as a closing part is provided with an exhaust duct 31 which is closed in a gas-tight manner by the sealing-joint 9.

Figure 4:
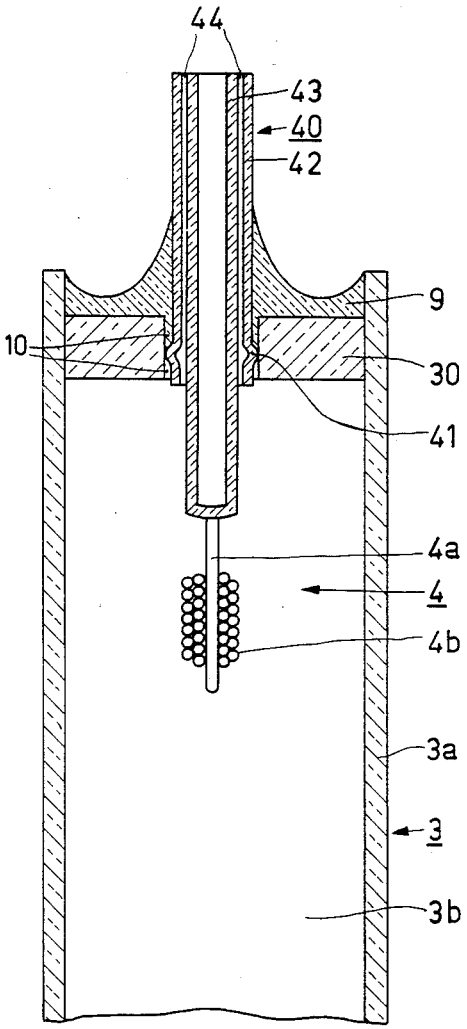
FIG. 4 is another modification of the lead-through element and the closing part of the discharge vessel according to FIG. 2.

In the modification shown in FIG. 4, parts corresponding to those in FIG. 1 and FIG. 2 are designated by like reference numerals. The lead-through element 40 is composed of a tube 42 provided with a protuberance 41 which is present along the whole periphery and reaches as far as the end plug 30 serving as the closing member. The tube 42 accommodates a cylinder 43, which is provided on the side facing the discharge space 3*b* with a main electrode 4. On the side 44 remote from the discharge space 3*b*, the cylinder 43 is connected in a gas-tight manner to the tube 42. This connection may be established, for example, by welding or by soldering. It is also possible to pinch the tube and the cylinder locally to flatness, which pinch may be covered with solder or sealing glass. At the area of the protuberance 41 the tube 42 is upset and is preferably made of niobium or molybdenum, just like the cylinder 43.

Figure 3:
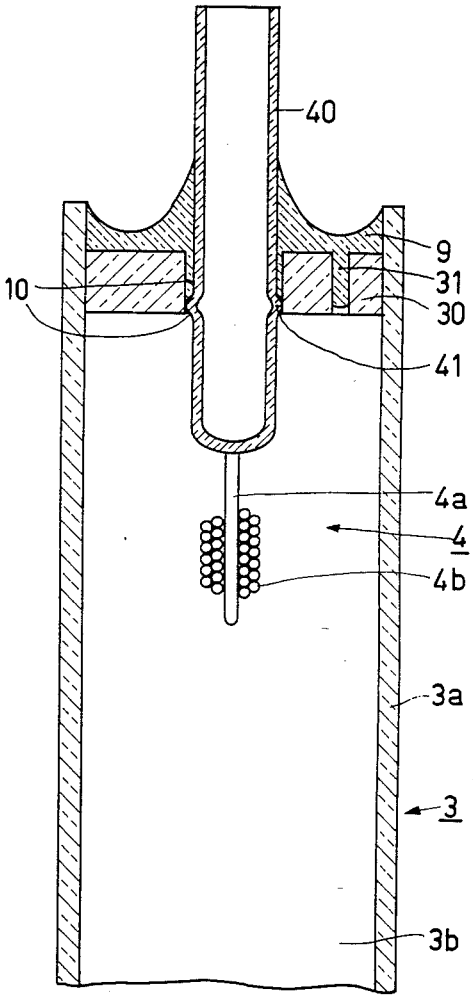
FIG. 3 shows a modification of the lead-through element and the closing part of the discharge vessel according to FIG. 2.

In a plurality of practical discharge vessels, the construction of which corresponds to the modification shown in FIG. 3, the wall of the discharge vessel, just like the end plug, consisted of densely sintered polycrystalline alumina. Each of the lead-through elements had an outer diameter of 2 mm of the part not upset, while the interspace at each lead-through element amounted on the average to 0.08 mm. The exhaust duct had a cross-section of 0.1 mm. The electrode rods, like the electrode turns, were made of tungsten. The electrode distance was 25 mm. The filling of the discharge vessel contained 10 mg Na-Hg-amalgam comprising 73% by weight of mercury and xenon, which at 300 K had a pressure of 50 kPa. With the use of such a discharge vessel in an outer bulb, a discharge lamp is obtained, which, when connected in series with a stabilization ballast of approximately 0.5 H and operated at a supply voltage of 220 V, 50 Hz, consumes a power of approximately 50 W.

Figure 5:
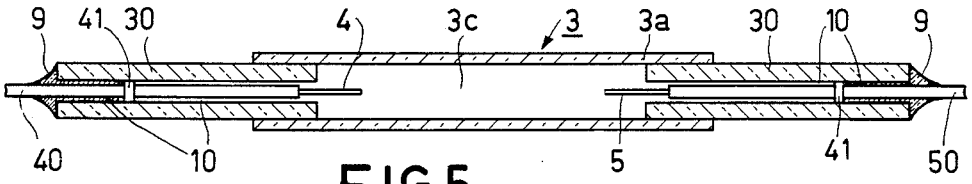
FIG. 5 is a sectional view of another modification of a discharge vessel.

In the modification of the discharge vessel 3 shown in FIG. 5, this vessel comprises a cylindrical part having a ceramic wall 3*a* which encloses the discharge space 3*c* and is closed on both sides by an end plug 30 serving as a closing part and extending partly outside the cylindrical part 3*a*. With an intermediate space 30 a pin-shaped lead-through element 40 and 50, respectively, is passed through each end plug. Each lead-through element 40 and 50, respectively, is provided with a pin-shaped electrode 4 and 5, respectively. A sealing joint 9 extends partly in the intermediate space 10 and constitutes a gas-tight joint between the end plug 30 and the lead-through element 40 and 50, respectively.

Figure 6:
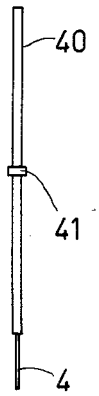
FIG. 6 shows in detail a lead-through element of the discharge vessel of FIG. 5.

The lead-through element 40, which is shown in detail in FIG. 6, is a pin-shaped body provided at one end with a likewise pin-shaped electrode 4. Halfway its length the lead-through element is provided with a protuberance 41 which is present around its periphery and is obtained by scraping the lead-through element 40. In a practical case according to this embodiment, the electrodes 4 and 5 consisted of tungsten pins having a cross-section of 200 μm and a length of 3 mm. The distance between the electrodes was 13 mm. The lead-through elements were constituted by niobium pins having a cross-section of 0.7 mm and the end plugs each had an inner diameter of 0.8 mm. The cylindrical discharge vessel part had an inner diameter of 2.5 mm. The ceramic wall and the end plugs consisted of densely sintered polycrystalline alumina and were connected to each other in a gas-tight manner by sintering. The filling of the discharge vessel contained 10 mg of mercury-sodium amalgam comprising 73 % by weight of mercury and xenon having at 300 K. a pressure of 53 kPa. With the use of such a discharge vessel in an outer bulb, a lamp is obtained which, when connected in series with a stabilization ballast of approximately 1.4 H and operated at a supply voltage of 220 V, 50 Hz, consumes a power of approximately 30 W.

What is claimed is:

1. A high-pressure discharge lamp comprising a discharge vessel having an opening in which a closing part is disposed, a lead-through element extending through said closing part, said discharge vessel enclosing a discharge base and being provided with a ceramic wall, said lamp including two main spaced apart electrodes, between which, in the operating condition of the lamp, a discharge takes place, at least one of said electrodes being connected to said lead-through element which is passed through said closing part, said lead-through element having at least a part thereof surrounded by said closing part with an intermediate space therebetween, said lead-through element being connected to said closing part by a sealing joint in a gas-tight manner, said sealing joint extending in said intermediate space, said lead-through element having a protuberance extending around the entire surface thereof, said protuberance cooperating with said closing part surrounding said lead-through element, said sealing joint extending in said intermediate space no closer to said discharge than said protuberance so that substantially all of said sealing joint is not exposed to the materials inside of said discharge space.

2. A lamp as claimed in claim 1, wherein said lead-through element is a metal pin and said protuberance constitutes a disturbed area of said metal pin.

3. A lamp as claimed in claim 1, wherein said lead-through element comprises a thin-walled metal tube and said protuberance constitutes an upset in said thin-walled metal tube.

4. A lamp as claimed in claim 3, wherein said tube has a cylinder disposed therein, said cylinder on the axial extremity facing the discharge being provided with a main electrode and the axial extremity remote from said discharge being secured to said tube in a gas-tight manner.

5. A lamp as claimed in claim 3, wherein said discharge vessel closing part is provided with a separate exhaust duct which is closed in a gas-tight manner by means of a sealing joint.

* * * * *